United States Patent [19]

Smith

[11] 4,007,035

[45] Feb. 8, 1977

[54] METHOD OF USING AN EXPENDABLE TAP HOLE TUYERE IN OPEN HEARTH DECARBURIZATION

[75] Inventor: Robert W. Smith, Lower Makefield Township, Bucks County, Pa.

[73] Assignee: United States Steel Corporation, Pittsburgh, Pa.

[22] Filed: Jan. 27, 1975

[21] Appl. No.: 544,162

Related U.S. Application Data

[63] Continuation of Ser. No. 365,775, May 31, 1973, abandoned.

[52] U.S. Cl. ..... 75/60; 266/225

[51] Int. Cl.[2] ..... C21C 5/48

[58] Field of Search ..... 75/60, 59; 266/41, 42

[56] References Cited

UNITED STATES PATENTS 3,823,931 7/1974 Wells ..... 266/42

*Primary Examiner*—Peter D. Rosenberg

*Attorney, Agent, or Firm*—Forest C. Sexton

[57] ABSTRACT

A process of making steel in an open hearth furnace utilizing an expendable tuyere inserted within the furnace tap-hole for injecting oxygen into the furnace charge to assist in oxidizing impurities from said charge.

13 Claims, 4 Drawing Figures

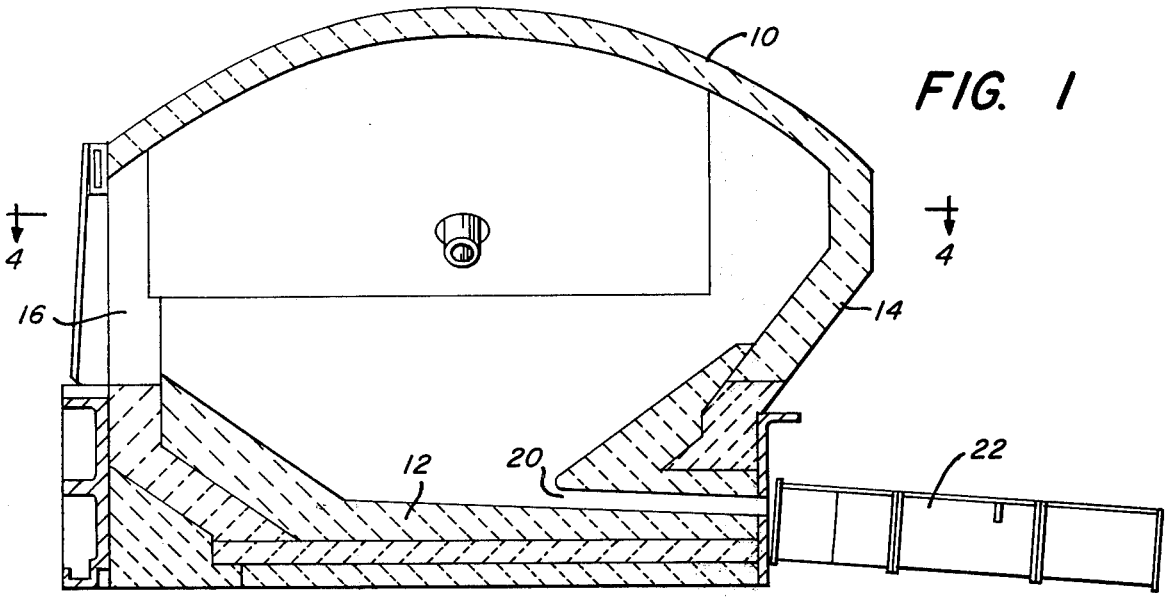
FIG. 1
FIG. 2
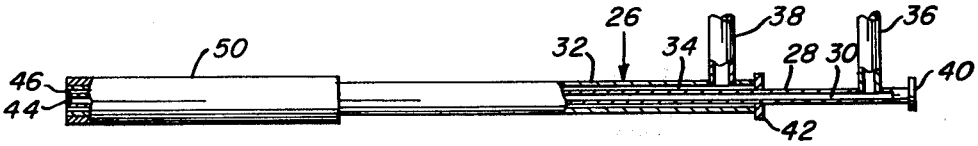
FIG. 3
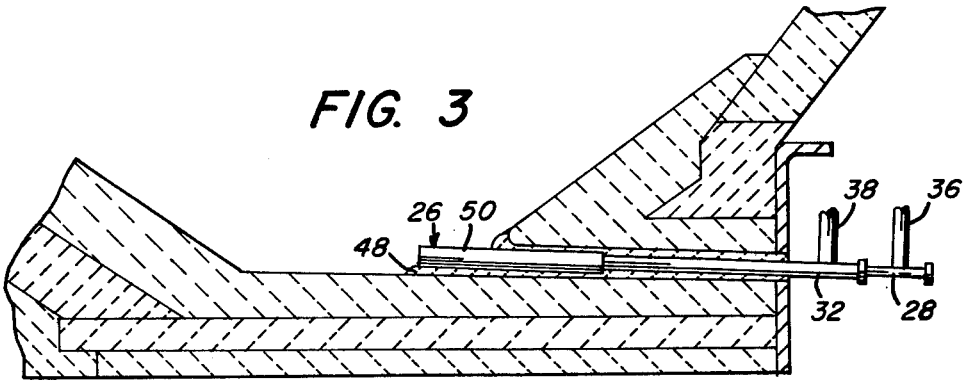

METHOD OF USING AN EXPENDABLE TAP HOLE TUYERE IN OPEN HEARTH DECARBURIZATION

This is a continuation of application Ser. No. 365,775, filed May 31, 1973, and now abandoned.

BACKGROUND OF THE INVENTION

With the advent of substantial quantities of oxygen available at reasonable cost there has been a revolution in the steelmaking industry based on the use of oxygen to decarburize and refine iron into steel. Indeed, the demise of the Bessemer converter and diminishing significance of the open hearth process attributable to the basic oxygen process is well known. Even where open hearth furnaces are still in use, many have been modified to utilize oxygen injection, most commonly through roof lances, to substantially increase capacity by reducing refining time by as much as 50 percent and more.

More recently, the bottom-blown basic oxygen process is beginning to receive considerable attention as being superior even to the conventional basic oxygen process. Whereas the conventional basic oxygen process utilizes a top lance to blow oxygen onto molten iron contained in an open tilting vessel, the bottom-blown basic oxygen process injects oxygen directly into the molten iron via tuyeres through the refractory vessel walls below the molten metal surface, for example, as disclosed in U.S. Pat. No. 3,706,549, Knuppel et al, issued Dec. 19, 1972. This new process is further characterized by utilizing double-pipe concentric tuyeres substantially flush with the inner refractory surface whereby oxygen is injected through a central orifice, and a protective jacket fluid, such as liquid or gaseous hydrocarbons, hydrogen, inert gases, carbon dioxide, steam, nitrogen or mixtures thereof, is blown through an annular orifice circumscribing the central oxygen orifice. The protective jacket fluid, usually natural gas, serves to envelop the oxygen upon initial injection into the melt to cool and protect the tuyere and the refractory walls adjacent to the tuyeres to thereby prevent rapid erosion of the tuyere and adjacent refractory.

The technical principles involved in the bottom-blown basic oxygen process are now also being incorporated into open hearth steelmaking facilities. That is to say, conventional open hearth furnaces are now being modified in some instances to provide double-pipe tuyeres through the refractory lining of the furnace below the molten metal surface, and then blowing oxygen, jacketed with a protective jacket fluid, into the molten metal. Indeed, many of the benefits of the bottom-blown basic oxygen process have been realized in using such modified open hearth furnaces. However, because the bottom of most open hearth furnaces is somewhat inaccessible, it has been necessary to locate the tuyeres through the furnace side wall. Even then, accessibility in some instances may be severely limited in view of pre-existing structural obstructions. Even in the absence of such obstructions, the installation of such tuyeres on existing furnaces requires a rather complicated drilling operation through the furnace side wall and complex external connections and appendages.

In addition to the above discussed minor problems, the placement of tuyeres in an open hearth side wall has caused a substantially more serious disadvantage as compared to conventional bottom tuyeres in tilting vessels. That is, the use of side wall tuyeres causes a rather rapid refractory erosion adjacent the tuyeres. Hence, despite the shielding gas envelope about the injected oxygen, bouyant forces acting on the injected oxygen and on the bath metal do result in gas and metal movement forces and patterns causing substantial refractory wear above and about the tuyeres. This erosion may be so severe that spot patching around each tuyere may be necessary after each heat. Furthermore, since the surrounding refractory is rapidly eroded, the tuyeres themselves are eroded substantially faster than experienced with bottom tuyeres in tilting vessels. This disadvantage is compounded by the fact that replacement of a plurality of tuyeres in a furnace side wall is not only difficult, but results in prolonged furnace downtime.

SUMMARY OF THE INVENTION

An object of this invention is to provide a method for producing steel in an open hearth furnace utilizing oxygen injection techniques which overcomes the above discussed disadvantages by utilizing a single, expendable tap-hole tuyere.

Another object of this invention is to provide a method for injection oxygen into a steelmaking open hearth furnace which will not severely erode the furnace refractory lining.

Another object of this invention is to provide a method for injecting oxygen into a steelmaking open hearth furnace which will not require any substantial modification of the internal furnace structure.

Still another object of this invention is to provide a method for injecting oxygen into a steelmaking open hearth furnace which utilizes an inexpensive, expendable tuyere easily replaceable after each heat.

A further object of this invention is to provide a tuyere of reduced material and costructional cost, for use in combination with a steelmaking open hearth furnace, insertable through the furnace tap-hole for injecting oxygen and a suitable protective jacket gas into a molten bath therein.

Still another object of this invention is to provide a process for refining molten metals utilizing an inexpensive, expandable tuyere.

Another object of this invention is to provide a metal refining furnace having an inexpensive, expendable tuyere for injecting oxygen into the metal to be refined.

A further object of this invention is to provide a steel refining furnace having an inexpensive, expandable tuyere for injecting oxygen into an unrefined metal charge within the furnace.

BRIEF DESCRIPTION OF THE DRAWINGS

FIG. 1 is a schematic end view of an open hearth steelmaking furnace shown in section at the midpoint of the furnace so as to show the furnace tap-hole.

FIG. 2 is a cross-sectional plan view of a tap-hole tuyere as may be used in the process of this invention.

FIG. 3 is an enlarged view of the furnace tap-hole shown in FIG. 1 furhter showing the tap-hole tuyere in position for operation.

DESCRIPTION OF THE PREFERRED EMBODIMENT

Figure 4:
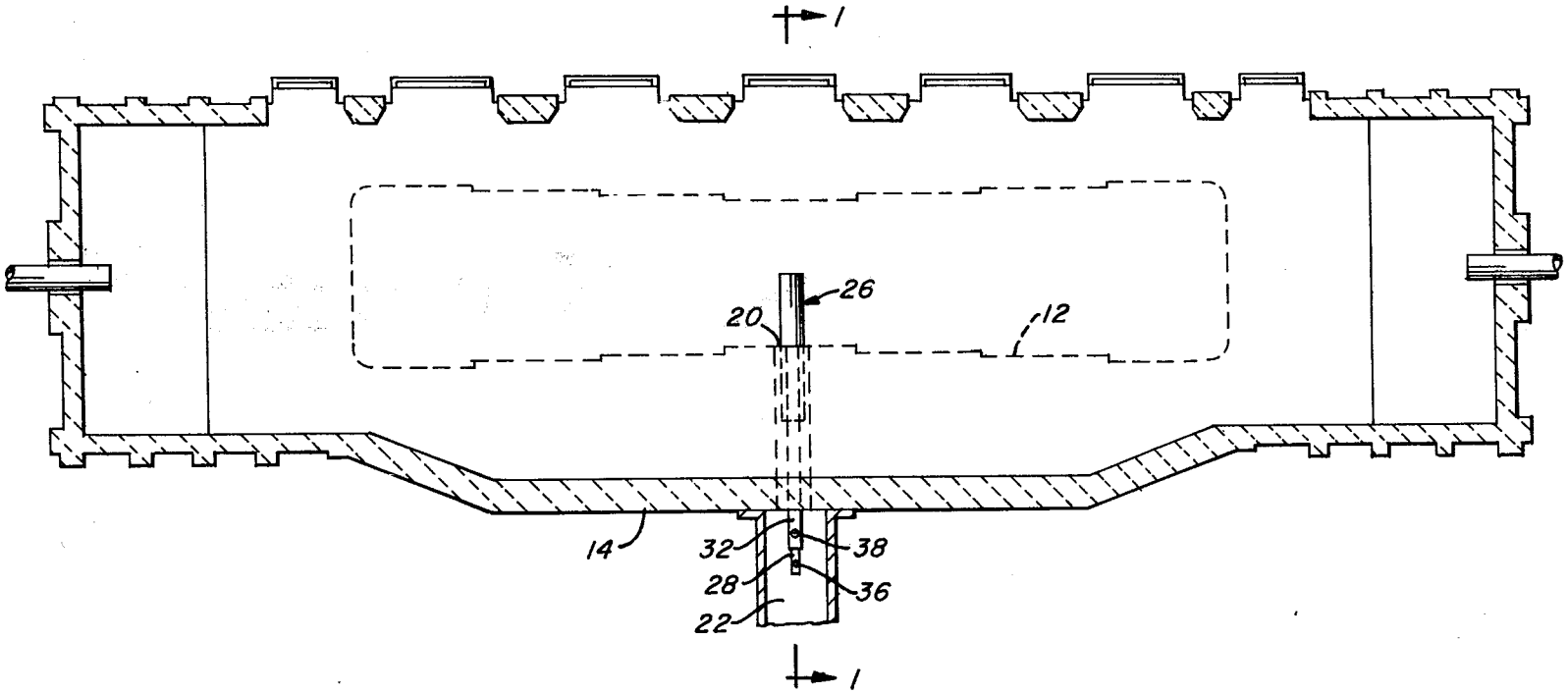
FIG. 4 is a plan view of an open hearth steelmaking furnace shown in section to illustrate the inside furnace bottom and showing the tap-hole tuyere in position for operation.

Briefly stated, the conventional method for producing steel in an open hearth furnace is to charge molten blast furnace metal, steel scrap and or iron ore and an oxidizing flux such as limestone, and then oxidize the impurities from the combined molten bath. The usual sources of oxygen for oxidation are the iron oxides in the scrap and ore, carbon dioxide from the calcination of the limestone and combustion air from the checkers. Usually, the limestone is charged first, then the scrap and/or ore is charged, melted and excessively oxidized by an oxygen rich burner and limestone calcination. Thereafter the blast furnace hot metal is charged, and the highly oxidized charge already in the furnace will serve to oxidize the impurities from the blast furnace hot metal. First the silicon and manganese are oxidized to $SiO_2$ and MnO and become part of the slag. When these are substantially removed, carbon oxidation becomes more vigorous and is evolved as CO gas. During this time, phosphorus is oxidized to $P_2O_5$ while sulfur is reacted to CaS, and each become part of the slag.

The more conventional methods for utilizing oxygen in an open hearth furnace can be divided into two categories. First, oxygen is used for "flame enrichment" whereby oxygen is added to the air admitted through the fuel fired end burners to increase the heat content. This use is commonly referred to as combustion oxygen. The second category is commonly known as bath or metallurgical oxygen, and provides for the injection of oxygen, usually through roof lances, into the furnace atmosphere above the molten metal. Oxygen is admitted during the oxidation period to more quickly oxidize the molten metal, and during the refining period to provide a supplemental source of oxygen for oxidation of impurities.

In more recent developments wherein bottom-blowing principles have been applied to the open hearth furnace, the practice has been to provide a plurality of double concentric tuyeres through the furnace backwall, and in accordance with conventional bottom-blowing techniques, inject oxygen through the central orifice while simultaneously injecting a protective jacket fluid such as natural gas through the outer annular orifice. As in bottom blowing, the oxygen serves to oxidize impurities from the molten metal, while the jacket fluid serves as a coolant and a shield to protect the tuyeres and the furnace refractory lining adjacent to the tuyeres.

As previously noted, however, rather substantial problems have been encountered in using such tuyeres in open hearth furnaces. The most significant being that, in spite of the protective jacket fluid, the tuyeres and the furnace refractory lining adjacent to the tuyeres are rapidly eroded. This substantially adds to the cost of operation, and causes delays between heats for patching. Furthermore, since the tuyeres are below the molten metal top surface, a burned-out tuyere can be hazardous and costly resulting in a substantial loss of furnace metal.

The crux of this invention resides in the elimination of the side-wall tuyeres altogether and substituting a single, expendable lance-like tuyere through the furnace tap-hole. Because the tap-hole is essential and already provided, no drilling or special arrangement is needed to provide such a tuyere. In fact, the furnace refractory lining is completely unaltered, and a tap-hole tuyere may be quickly inserted on any conventional open hearth furnace without requiring any furnace structural modifications whatsoever.

To illustrate one embodiment of the practice of this invention, reference is made to the drawings where FIG. 1 schematically illustrates a sectional end view of a conventional open hearth furnace having a refractory roof 10, floor 12, back wall 14 and front wall 16. The section is taken at the furnace midpoint to show the tap-hole 20. The tapping trough 22 is also shown.

FIG. 2 illustrates a tap-hole tuyere 26 as may be used in the practice of this invention. The tuyere 26 comprises an elongated central tubular member 28, having an opening 30 therethrough and a slightly shorter tubular member 32 concentrically disposed about tubular member 28 to define an annular opening 34 between the inner wall of member 32 and the outer wall of member 28. At one end of the tuyere, a pair of inlet pipes 36 and 38 are provided to admit, respectively, oxygen into the central opening 30 and a protective jacket fluid into the annular opening 34. At the same end of the tuyere, closure means such as caps 40 and 42 are provided at the ends of tubular members 28 and 32 respectively, to close openings 30 and 34 respectively. The other end of the tuyeres is left open to provide a central orifice 44 for emitting oxygen and an annular orifice 46 for emitting the protective jacket fluid. To maintain the tuyere rigid, one or more solid spacers (not shown) may be positioned within annular opening 34. If desired, the outlet end of the tuyere may be provided with a refractory coating or sleeve 50, particularly if the tip thereof is to extend beyond the furnace side-wall refractory so that the sides of the tuyere are exposed to molten metal.

FIG. 3 illustrates how the tap-hole tuyere 26 is inserted into the tap-hole 20 shown in FIG. 1. In essence, all that is necessary is that the open end of the tuyere 26 be inserted through the furnace tap-hole 20 and sealed in place by packing dolomite or other suitable packing material around the tuyere 26 within tap-hole 20. It is preferable to place a mound of packing material 48 on the furnace refractory floor 12 just inside the tap-hole 20 so that the inside tip of tuyere 26 is angled slightly upward away from the furnace refractory floor 12 to prevent excessive erosion of the floor 12. After the tuyere 26 is placed on the mound of packing material 48, such that the tip of the tuyere is at approximately the center of the furnace and the inlet pipes 36 and 38 are entending upward, the balance of tap-hole 20 is packed. Inlet pipes 36 and 38 are then respectively connected to a source of oxygen and shielding gas. It is also preferred that the system be capable of supplying inert gas to both inlet pipes as used in conventional bottom-blowing practices. Such gas may be blown through the tuyere to keep the tuyere open during quiescent periods.

In practice, after an open hearth furnace is tapped and readied for the next heat, the tuyere 26 is inserted and packed in place as described above. This procedure is not excessively time-consuming since even without a tap-hole tuyere it is necessary to pack the tap-hole so the furnace will retain its charge. The furnace may then be charged with scrap and limestone, etc. according to conventional practices. During the melt down period, gases must be emitted through both tuyere openings to prevent the flow of molten thereinto and to protect the tuyeres from overheating. Although inert gases may be used for this purpose, it is preferred to inject oxygen through the central orifice 41 and a combustible hydrocarbon fuel, such as natural gas, propane, fuel oil or the like, through the annular orifice 46 thereby to contribute heat for melt down. That is, oxygen injection at this stage of the process would serve as combustion oxygen, and the ratio of oxygen to fuel regulated to provide optimum or near optimum combustion conditions.

When the scrap has been preheated or sufficiently oxidized or melted as desired; the molten blast furnace hot metal is charged and a metallurgical oxygen blow commenced. During this blow, oxygen serves to refine impurities from the charge by saturating the bath with supplemental oxygen in accordance with conventional practices where back-wall tuyeres have been used. Although the practice of this invention utilizes only one tuyere, in contrast to a plurality of tuyeres as previously used, the single tuyere will substantially saturate the charge with oxygen so that very little is sacrificed by the absence of a plurality of tuyeres. As in conventional bottom-blowing practices and back-wall open hearth blowing practices, the relationship between oxygen and jacket gas should be carefully regulated to prevent refractory erosion and excessive heating or cooling. In the practice of the present invention, the protective jacket fluid preferably comprises hydrocarbons in amounts ranging from small percentages of the injected oxygen effective to preclude metal entry into opening 34 and providing refractory and tuyere erosion protection up to about maximum amounts insufficient to overcool the tuyere and thus cause opening 34 to be blocked with frozen metal. Although the preferred amount will depend upon the fluid used for the protective jacket fluid, optimum results for natural gas are usually achieved by using 5 to 20 volume percent of oxygen flow or ideally about 8 volume percent (4% by weight). The total flow rate of injected fluids will vary depending upon the rate of metal refining desired, the capacity of the off-gas cleaning equipment; if such equipment is used and other factors.

When the heat has been refined to the extent desired, it is preferable to terminate the oxygen-jacket fluid blow and instead blow with an inert gas through both openings 30 and 34. Although such a switch-over is not essential, it is preferred as a final cleaning step and to prevent excessive oxidation of iron. In any event, gases or fluids must be constantly blown through both openings 30 and 34 to prevent molten iron from flowing thereinto.

When the heat is ready to be tapped, it is not necessary to burn-out or blast-out the tap-hole plug as has been the past practice. On the contrary, all that is necessary is that the operator disconnect or shut-off the two fluid lines feeding the tap-hole tuyere, or at least cut the inlet pressures to a value insufficient to overcome the ferrostatic head. At this point when the injected fluids fail to overcome the ferrostatic head of the molten metal in the furnace, the metal will immediately flow into the tuyere openings 30 and 34 quickly melting tubular members 28 and 32, and thereby commence to flow from the furnace. Hence, the mere act of shutting-off or disconnecting the fluid supply lines to the tuyere will, by itself, cause the furnace to be tapped.

As explained above, the open hearth furnace will tap itself upon termination of the fluid supply by melting out the tap-hole tuyere. When the furnace is tapped, the entire procedure can be repeated, requiring of course an entirely new tap-hole tuyere.

The above described process can be used to refine a conventional open hearth heat in at least about two hours less time than prior art practices. Although this time-saving is no better than can be realized with the more conventional back-wall submerged tuyeres, it is nevertheless comparable thereto and does offer considerable advantages in other respects as already noted. Since the emission end of the tap-hole tuyere 26 is at the approximate center of the furnace, it is spaced well away from the furnace side walls, and therefore cannot significantly erode the side walls as do the more conventional side-wall tuyeres. The closest refractory surfaces to the tap-hole tuyere 26 are the furnace bottom 12 and the inner mouth of the tap-hole 20. These however are not severely eroded. The furnace refractory bottom escapes appreciable erosion because the tap-hole tuyere 26 is angled upwardly away from the bottom 12, and because the bouyant forces acting on the injected oxygen carry the oxygen upwardly away from the bottom 12. The inner mouth of tap-hole 20 is not severely eroded because the refractory surfaces thereof are similarly underneath and slope away from the emission end of tap-hole tuyere 26. It should be further noted that in conventional open hearth operations wherein oxygen is not used, the tap-hole area is usually the most severely eroded refractory surface due to the dynamic forces thereon when the heat is tapped. Because of this, tap-hole repairing techniques and procedures have already been highly developed. Therefore, any additional erosion to the tap-hole area caused by the gas injection of this inventive process, is usually more easily repaired than are other, less accessible refractory surfaces.

As shown in FIG. 3, the orifice end of tap-hole tuyere 26 may be positioned such that it is not flush with the furnace refractory lining as are the more conventional back-wall tuyeres but rather projects beyond the mouth of the tap-hole 20 to expose side surfaces of the tuyere. Therefore, the tap-hole tuyere 26 is itself substantially more severly eroded than are such back-wall tuyeres. This is not however of major concern since the tap-hole tuyere 26 is necessarily expendable to be used for one heat only as described above. However, if the exposed portion of the tuyere 20 is eroded faster than desired, such erosion can be retarded by compacting packing material therearound such as magnesium oxide.

Since tap-hole tuyere 26 is an expendable, one-heat tuyere, it offers further advantages in being susceptible to fabrication from low cost materials. That is to say, the prior art back-wall tuyeres are very difficult to replace, and therefore, every effort is made to prolong their life. To this end, the central oxygen pipe of the back-wall tuyeres are usually fabricated from costly high-temperature alloys such as AISI Type 304 stainless steel. Contrary thereto, a long life for the tap-hole tuyere 26 of this invention is not desired, and therefore tuyere 26 may be fabricated from cheaper conventional carbon or low carbon steels.

Although the above described process is detailed along the lines of my preferred practice, numerous modifications could be incorporated without departing from the basic concept of the invention, that basic concept being the provision of only one tuyere through the furnace tap-hole 20. Hence, various processing modifications, consistent with variable open hearth practices and variable bottom blowing practices can be incorporated into the above process. For example, conventional bottom-blowing practices frequently utilize equipment modifications whereby a finely divided flux such as lime may be entrained within the oxygen injected into the molten metal. In a like manner, the inventive process described herein could utilize a feed system whereby lime, or any other finely divided flux could be selectively injected into the melt with the oxygen. As is some bottom-blowing practices, provisions could be made in the tuyere feed system to selectively provide nitrogen to either or both tuyere orifices so as to use a less costly gas to keep the tuyere open during melt-down for example. Hence, the tuyere 26 need not be employed to provide combustion oxygen during melt-down if not so desired. Furthermore, the blowing of oxygen for refining purposes, i.e., metallurgical oxygen, may be maximized or minimized depending upon specific objectives. Countless modifications could be made in the tuyere design without departing from the spirit of the invention. Since the tuyere is expendable, and necessarily destroyed upon tapping of the heat, I believe the basically simple design shown in FIG. 2 is optimal from a cost standpoint. Nevertheless, more complicated tuyeres could be utilized, for example, tuyeres wherein the end thereof within the furnace is provided with at least one central orifice for oxygen injection and at least one concentric orifice therearound for injection of the jacket fluid. If, in any case of extreme process conditions, such as the use of abnormally high metal temperatures, etc., the tuyere, or at least the portion of the tuyere insertable within the furnace, may of course be constructed of more refractory materials. For example, in actual practice I have found it desirable to cast a magnesium oxide sleeve 50 around the tip of the tuyere and extending back about 18 to 36 inches. As another example, the invention can be practiced with the use of a refractory ceramic material in the construction material for one or both of the tuyere tubes, provided that the full advantages of the self-tapping feature inherent in the use of a metal tuyere is not desired.

In addition to the above discussed modifications that could be made to the apparatus and process as detailed, there are other embodiments of this invention which give it a rather wide latitude of application. For example, it is obvious that the basic principles of this invention could be applied to the processes for refining metals other than steel. Examples thereof would include use of tap-hole tuyeres on other reverberatory refining furnaces such as used in refining lead and copper. Further, the tap-hole tuyere need not be limited to reverberatory type furnaces such as an open-hearth, but could be applied to virtually any type of refining vessel having a tap-hole, and further applied to utilization of refining fluids other than oxygen, such as air, steam, inert gas, etc.

When refining non-ferrous metals such as lead and copper, the temperatures involved are substantially lower than those involved in refining steel, and therefore, there is little likelihood of excessive temperature sufficient to unreasonably erode the tuyere and adjacent refractory surfaces. In these applications therefore the protective jacket fluid is not necessary. Hence, pure oxygen may be admitted through a single pipe tap-hole tuyere in such applications without the danger of overheating.

With the above considerations in mind, it should be realized that the use of a protective jacket fluid in refining steel is solely for the purpose of preventing overheating and the severe tuyere and refractory erosion which would result from pure oxygen injection. Accordingly, if such adverse effects can be tolerated, or are minimized by other means, then obviously the tap-hole tuyere of this invention may be used without the protective jacket and even in steel refining. To this end, a single pipe tap-hole tuyere to inject only oxygen may be used to advantage in steel refining if the pipe is constructed of a refractory material, or coated therewith in such manner that the tuyere will last at least as long as it takes to make one heat. Illustratively, such tuyere pipe, or at least a portion thereof adjacent the oxygen outlet and exposed to highest operating temperature, may be constructed of a suitable ceramic material such as aluminum oxide, magnesium oxide, mullite (aluminum oxide-silica mixture) or the like, or more preferably a magnesium oxide sleeve having a thin inner lining of high density mullite or aluminum to seal against oxygen leakage through the refractory wall. With such a practice, if required, overheating may be minimized by injecting oxygen at a reduced rate, or in a diluted form. As an alternative, the overheating problem may be reduced by coating the single pipe tap-hole tuyere with solid endothermically decomposable material such as pitch or limestone which would absorb the heat as it and the tuyere are burned back. On the other hand, such material could be injected in granular or gaseous form within the oxygen stream.

EXAMPLES

The following examples are illustrative of the practice of this invention.

For one test heat (Heat O6T348), a tuyere was prepared substantially as shown in FIG. 2, fabricated from seamless carbon steel pipe. The outer pipe had a 3.750 -inch outside diameter, while the inside pipe had a 2.875-inch inside diamter. A magnesium oxide sleeve, about 5 inches in diameter and about 36-inches in length, was cast about the outlet-end of the tuyere to a density of about 170 lb./cubic foot. The total tuyere, including two inlet pipes approximately 11-feet in length, weighed about 300 pounds.

A conventional open hearth furnace was readied, and after the trough or runner was hung and packed, the tuyere was inserted through the tap-hole using a jib crane, so that tuyere tip extended approximately one-foot into the furnace hearth beyond the refractory side wall above the tap-hole mouth. The void space around the tuyere was packed with dolomite on the inward side and backed-up with runner clay within the outward portion. The tuyere was then coupled to suitable piping for gas delivery utilizing check values to assure that would be no back-flow of one gas into the delivery lines of the other gas.

Upon commencement of charging the furnace, nitrogen gas was blown through both tuyere openings at a rate sufficient to prevent back-flow of molten iron into the tuyere. Approximately midway through the charging operation, the gas flow was switched over to blow oxygen through the central tuyere opening at a rate of 2500 SCFM and natural gas through the annular opening at a rate of 200 SCFM to assist in scrap melt down. The charging was then completed, and the refining operation continued in the usual manner but for the tap-hole tuyere which continued to admit oxygen and natural gas at the above started rates. The oxygen pressure did however fluctuate between 34 and 40 psi during the refining stage and hence the oxgen rate did fluctuate somewhat. During the refining stage, the metal was sampled at various intervals to determine the extent of decarburization. When the desired carbon content was reached, i.e., 0.05% C, the furnace was tapped by terminating the natural gas blow, and reducing the oxygen blow to 8–10 psi. Approximately 15-seconds thereafter, the hot steel within the furnace melted out the tuyere and the tap followed. The tap was excellent, being completed in less than 15 minutes, yielding 381.9 net tons of good ingots.

In a subsequent test heat (Heat O6T352), substantially the same procedure was followed to produce 412 net tons of good ingots.

The table below provides the operating parameters for the two above test heats. Where applicable, for comparative purposes, the table also shows the typical values for conventional open hearth operation utilizing two roof oxygen lances on the same open hearth furnace.

TABLE

Process Parameters for Experimental Heats 06T348 and 06T352

| | Heat 06T348 | Heat 06T352 | Conventional Open Hearth Practice |
|---|---|---|---|
| TIME | | | |
| Start Charge | 12:55 PM | 1:15 PM | |
| Finish Charge | 1:30 PM | 2:10 PM | |
| Oxygen (Natural Gas "ON" | 2:05 PM | 1:45 PM | |
| First Ladle (Hot Metal) | 2:15 PM | 2:30 PM | |
| Second Ladle (Hot Metal) | 2:25 PM | 2:40 PM | |
| Sampling | 2:55 PM | 3:45 PM | |
| | 3:10 PM | 4:00 PM | |
| | 3:35 PM | 4:15 PM | |
| | 4:05 PM | 4:35 PM | |
| Start Tap | 4:12 PM | 5:15 PM | |
| Finish Tap | 4:25 PM | 5:25 PM | |
| Charge-to-Tap (Hr:Min) | 3:30 | 4:15 | 6:48 |
| Tap-to-Tap (Hr:Min) | 7:08 | 6:35 | 7:32 |
| OXYGEN DECARBURIZATION RATE | | | |
| Per Minute (SCFM) | 2,500 | 2,500 | |
| Per Hour (SCFM) | 150,000 | 150,000 | |
| Total Time (Hr:Min) | 2:00 | 2:40 | |
| Total Volume (SCFM) | 375,500 | 375,000 | |
| Per NT of Ingot (SCF/NT Ingot) | 975 | 910 | 975 |
| NATURAL GAS | | | |
| Decarburization Rate (% of 02) | 9.67 | 8.00 | None |
| Total Volume (SCF) | 36,000 | 30,000 | None |
| Per NT of Ingot (SCF/NT Ingot) | 94.3 | 72.8 | None |
| PRODUCTION | | | |
| Charge-to-Tap (Tons/Hr) | 109.1 | 69.9 | 58.2 |
| Tap-to-Tap (Tons/Hr) | 53.8 | 62.9 | 52.5 |
| HEAT SIZE | | | |
| Tapped (Good Ingots) | 381.9 | 412.0 | 395.8 |
| Yield (%) | 77.6 | 86.6 | 83.1 |
| Fuel Consumption (Million BTU/NT Ingot) | 0.729 | 0.921 | 2.2 |
| Nitrogen Consumption (Total Volume | 116,000 | 116,000 | None |
| (Per NT of Ingot) | 303.74 | 281.55 | None |

A look at the above data will show that the process disclosed herein can readily show more than three hours off-of the charge-to-tap time. Although the tap-to-tap time savings were not as impressive, this was due to inexperience in installation of the tap-hole tuyere, and can be easily shortened with practice and with development of better practice particularly in packing dolomite about the tuyere. Note particularly that although the second heat took 45 minutes longer to decarburize than the first heat, the total tap-to-tap time of the second heat was more than 40 minutes shorter. This was primarily due to less time lost in installing the tuyere. It should also be noted that the oxygen injection process of this invention actually was the same or even less oxygen than conventional practice with roof lances. Although the yield for Heat O6T348 appears to be below typical values, this was due to factors apart from this process. The most significant of the above figures however is the substantial increase in production rate resulting from this inventive practice. Note that the charge-to-tap production rate was almost doubled; and also that the fuel consumption was reduced by more than 50%.

I claim:

1. A process for refining molten iron in a refractory-lined open hearth furnace, comprising:

a. inserting a tuyere in a passage extending through the furnace and the refractory lining thereof and communicating with the interior of the furnace in a position whereby molten iron contained in the furnace may be discharged through said passage;

b. providing molten iron in the furnace and, while said iron is contained in the furnace, injecting a refining fluid through the tuyere and into the iron for a period of time sufficient to substantially refine the iron, and tapping the refined iron through the tuyere.

2. A process in accordance with claim 1, wherein the refining fluid is oxygen.

3. A process in accordance with claim 2, wherein the refining fluid comprises a stream of oxygen and a protective jacket fluid selected from the group consisting of hydrocarbon, inert gas, steam, carbon dioxide, and non-explosive mixtures thereof is simultaneously injected enveloping said stream of oxygen.

4. A process in accordance with claim 3, wherein the protective jacket fluid comprises at least an effective amount of a hydrocarbon.

5. A process in accordance with claim 2, wherein the passage is the furnace tap-hole.

6. A process in accordance with claim 5, wherein the refining fluid comprises a stream of oxygen and a protective jacket fluid comprising a hydrocarbon in an amount from an effective amount up to about 20 weight percent of the injected oxygen is simultaneously injected enveloping said stream of oxygen.

7. A process in accordance with claim 4, wherein the hydrocarbon is in a gaseous state upon introduction thereof into the tuyere.

8. A process in accordance with claim 7, wherein an inert gas is substituted for oxygen and protective jacket fluid after completion of refinement of the iron and prior to tapping of the iron and without interruption of fluid injection into the melt.

9. A process in accordance with claim 2, wherein:

a. solid iron-base metal is added to the furnace, and b. the solid metal is preheated by injection of at least one heated gas stream into the furnace above the metal melt level.

10. A process in accordance with claim 3, wherein solid iron-base metal is added to the vessel and preheated by injection of oxygen and hydrocarbon fuel through the tuyere.

11. A process in accordance with claim 10, wherein preheating and melting of the solid metal is facilitated by injection of at least one heated gas stream into the furnace above the metal melt level.

12. A process in accordance with claim 2, wherein a solid particulate material is suspended in the injected oxygen.

13. A process in accordance with claim 12, wherein the particulate material is lime.

* * * * *